US005596829A

United States Patent [19]

Komamura

[11] Patent Number: 5,596,829

[45] Date of Patent: Jan. 28, 1997

[54] PICTURE FRAME DEVICE

[75] Inventor: Takeo Komamura, Matsudo, Japan

[73] Assignee: Sofken Co., Ltd., Tokyo, Japan

[21] Appl. No.: 307,618

[22] PCT Filed: Feb. 9, 1994

[86] PCT No.: PCT/JP94/00190

§ 371 Date: Sep. 16, 1994

§ 102(e) Date: Sep. 16, 1994

[87] PCT Pub. No.: WO94/17701

PCT Pub. Date: Aug. 18, 1994

[30] Foreign Application Priority Data

Feb. 12, 1993 [JP] Japan ..... 5-009406

[51] Int. Cl.[6] ..... G09F 1/12

[52] U.S. Cl. ..... 40/721; 40/782; 40/793

[58] Field of Search ..... 40/152, 152.1, 40/156, 721, 782, 793

[56] References Cited

U.S. PATENT DOCUMENTS 4,512,095 4/1985 Seely .
5,038,935 8/1991 Wenkmon et al. ..... 40/156 X
5,189,820 3/1993 Komamura ..... 40/156

FOREIGN PATENT DOCUMENTS 3-99611 4/1991 Japan .
2223874 4/1990 United Kingdom .

*Primary Examiner*—Kenneth J. Dorner
*Assistant Examiner*—Cassandra Davis
*Attorney, Agent, or Firm*—Koda and Androlia

[57] ABSTRACT

A picture frame device which allows the framing straight members to be removed from the front of the frame device by pivotally rotating the corner joints and has a space formed in a container installed behind the exhibit or the exhibit held between holding sheets, for containing many other exhibitable sheets than the exhibit such as pictures and testimonials.

The picture frame device is comprised of framing straight members, corner joints pivotally rotatably fitted at the respective both ends of the framing straight members, an exhibit or an exhibit held between holding sheets held on the front side of the framing straight members, and a container installed behind the exhibit or the exhibit held between holding sheets, and the container has a space formed, and together with the exhibit or the exhibit held between holding sheets, it is installed between the holding portions of the framing straight members and the corner joint boards, or together with the exhibit or the exhibit held between holding sheets, the flanges are held between the holding portions of the framing straight members and the partitions.

1 Claim, 4 Drawing Sheets

PICTURE FRAME DEVICE

TECHNICAL FIELD

The present invention relates to a picture frame device for displaying a sheet-like exhibit such as a picture or testimonial, etc. In more detail, the present invention relates to a frame device which has a space for containing other exhibitable sheets than the exhibit.

BACKGROUND TECHNIQUE

General practically used picture frame devices do not have any space for containing any other exhibitable sheets than the exhibit. So, it is practiced to keep those other exhibitable sheets behind the exhibit in layers, but many exhibitable sheets cannot be contained in this way.

There are also picture frame devices with a space for containing other exhibitable sheets than the exhibit, but most of them simply has a separate detachable container behind them. So, it is troublesome to take out the other exhibitable sheets than the exhibit for exchanging the exhibit or confirming those exhibitable sheets.

Furthermore, there is a picture frame device with an exhibit and a transparent resin sheet overlapped on a back sheet made of foam styrene surrounded on the four sides by U-shaped framing straight members connected by joints at the butt corners. The frame device allows the exhibit to be taken in and out by removing only one of the framing straight members, but if other exhibitable sheets than the exhibit are contained in layers as described above, it is troublesome to confirm the other exhibitable sheets.

If these other exhibitable sheets than the exhibit such as pictures and testimonials are kept in a cylindrical container, they are kept curled and must be straightened when exhibited.

OBJECT OF THE INVENTION

The object of the present invention is to present a picture frame device which allows the framing straight members to be removed from the front of the frame device by pivotally rotating the corner joints and has a space formed in a container installed behind the exhibit or the exhibit held between holding sheets, for containing many other exhibitable sheets than the exhibit such as pictures and testimonials.

DISCLOSURE OF THE INVENTION

The present invention is comprised of framing straight members, corner joints pivotally rotatably fitted at the respective both ends of the framing straight members, an exhibit or an exhibit held between holding sheets held on the front side of the framing straight members, and a container installed behind the exhibit or the exhibit held between holding sheets, wherein each of the framing straight members has a holding portion formed inward at its front end to hold the surface of the exhibit or the exhibit held between holding sheets and a pivotal rotation supporting portion formed inward at its back end; from an intermediate position between the holding portion and the pivotal rotation supporting portion, extended is a partition at least partially located on the pivotal rotation arc formed with the pivotal rotation supporting portion as the approximate center; each of the corner joints has a pivotal rotation base strip engaged, at its back end, with the pivotal rotation supporting portion of the framing straight member, and capable of being kept, at its front end, in slidable contact with the partition and engaged partially with the partition; from the pivotal rotation base strip, an arcuate portion is extended to be able to be kept in slidable contact and engaged with the tip of the partition; from the arcuate portion, a corner joint board is further extended; and the container has a space formed, and together with the exhibit or the exhibit held between holding sheets, it is installed between the holding portions of the framing straight members and the corner joint boards. And the present invention is comprised of framing straight members, corner joints pivotally rotatably fitted at the respective both ends of the framing straight members, an exhibit or an exhibit held between holding sheets held on the front side of the framing straight members, and a container installed behind the exhibit or the exhibit held between holding sheets, wherein each of the framing straight members has a holding portion formed inward at its front end to hold the surface of the exhibit or the exhibit held between holding sheets and a pivotal rotation supporting portion formed inward at its back end; from an intermediate position between the holding portion and the pivotal rotation supporting portion, extended is a partition at least partially located on the pivotal rotation arc formed with the pivotal rotation supporting portion as the approximate center; each of the corner joints has a pivotal rotation base strip engaged, at its back end, with the pivotal rotation supporting portion of the framing straight member, and capable of being kept, at its front end, in slidable contact with the partition and engaged partially with the partition; from the pivotal rotation base strip, an arcuate portion is extended to be able to be kept in slidable contact and engaged with the tip of the partition; from the arcuate portion, a corner joint board is further extended; and the container has a space formed with flanges at its edges, and together with the exhibit or the exhibit held between holding sheets, the flanges are held between the holding portions of the framing straight members and the partitions.

ACTION OF THE INVENTION

The picture frame device of the present invention has a space formed in a container installed behind the exhibit or the exhibit held between a transparent holding sheet and a back holding sheet. The framing straight members and corner joints are connected pivotally rotatably, and the space can contain many other exhibitable sheets than the exhibit. The framing straight members can be pivotally rotated to allow the exhibit and other exhibitable sheets to be taken in and out at the front of the frame device.

THE MOST PREFERRED EMBODIMENT OF THE INVENTION

Figure 1:
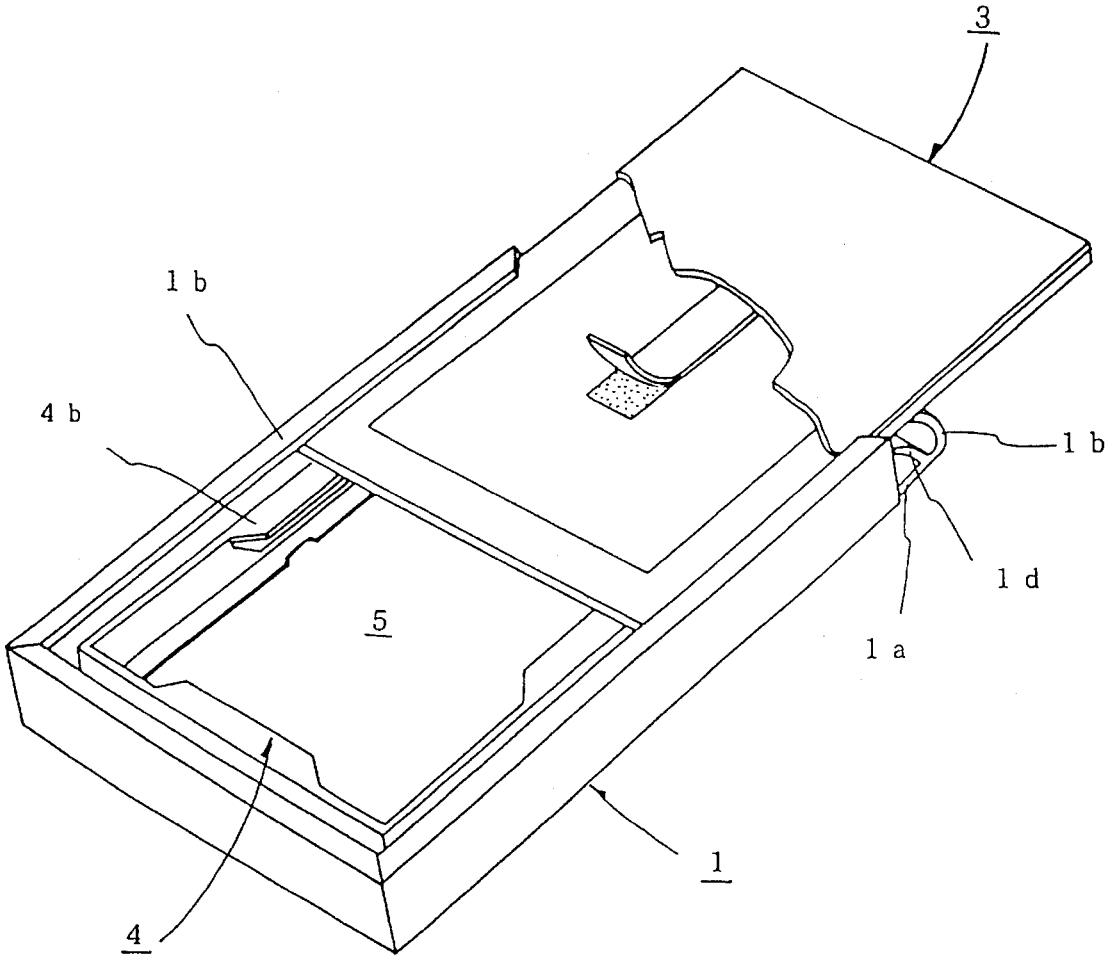
FIG. 1 is a general perspective view showing an example of the present invention.

The present invention relates to a picture frame device for displaying a sheet-like exhibit such as a picture or testimonial, etc. The present invention is comprised of framing straight members 1, corner joints 2 pivotally rotatably fitted at the respective both ends of the framing straight members 1, an exhibit 3 or an exhibit held between holding sheets 3 held on the front side of the framing straight members 1, and a container 4 installed behind the exhibit 3 or the exhibit held between holding sheets 3, wherein each of the framing straight members 1 has a holding portion 1*b* formed inward at its front end to hold the surface of the exhibit 3 or the exhibit held between holding sheets 3 and a pivotal rotation supporting portion 1*c* formed inward at its back end in the side 1*a*; from an intermediate position between the holding portion 1*b* and the pivotal rotation supporting portion 1*c*, extended is a partition 1*d* at least partially located on the pivotal rotation arc formed with the pivotal rotation supporting portion 1*c* as the approximate center; each of the corner joints 2 has a pivotal rotation base strip 2*c* engaged, at its back end 2*a*, with the pivotal rotation supporting portion 1*c* of the framing straight member 1, and capable of being kept, at its front end 2*b*, in slidable contact with the partition 1*d* and engaged partially with the partition 1*d*; from the pivotal rotation base strip 2*c*, an arcuate portion 2*d* is extended to be able to be kept in slidable contact and engaged with the tip of the partition 1*d*; from the arcuate portion 2*d*, a corner joint-board 2*e* is further extended: and the container 4 has a space 5 formed, and together with the exhibit 3 or the exhibit held between holding sheets 3, it is installed between the holding portions 1*b* of the framing straight members 1 and the corner joint boards 2*e*. The container 4 has a space 5 formed with flanges 4*a* at its edges, and together with the exhibit 3 or the exhibit held between holding sheets 3, the flanges 4*a* are held between the holding portions 1*b* of the framing straight members 1 and the partitions 1*d*.

The framing straight members 1 of a picture frame device of the present invention are made of a metal such aluminum or a synthetic resin such as acrylic resin, and are usually cut at 45 degrees at both the ends respectively, being arranged to form a rectangle and connected by corner joints 2.

Each of the framing straight members 1 is flat in the strip portion 1*a* in the illustrated example, and is curved, bent or swollen inward at its front end to form a holding portion 1*b* for holding the surface of the exhibit 3 or the exhibit held between holding sheets 3, while it also has a grooved pivotal rotation supporting portion 1*c* formed inside at its back end, to accept the back end 2*a* of a pivotal rotation base strip 2*c* of the corner joint 2 described later. From an intermediate position between the holding portion 1*b* and the pivotal rotation supporting portion 1*c*, extended is a partition 1*d* at least partially located on the pivotal rotation arc formed with the pivotal rotation supporting portion 1*c* as the approximate center. The partition 1*d* is ideally arcuate, but can also be bent with an angle as far as it is at least partially located on the pivotal rotation arc formed with the pivotal rotation supporting portion 1*c* as the approximate center.

On the other hand, the corner joint 2 has the pivotal rotation base strip 2*c* with its back end 2*a* engaged with the pivotal rotation supporting portion 1*c*, and the front end 2*b* of the pivotal rotation base strip 2*c* can be kept in slidable contact with the inside of the partition 1*d* of the framing straight member 1 and be partially engaged with part of the partition 1*d*. From the pivotal rotation base strip 2*c*, extended is an arcuate portion 2*d* which can be kept in slidable contact with the tip of the partition 1*d* and be engaged with the tip of the partition 1*d*. From the arcuate portion 2*d*, a corner joint board 2*e* is extended in parallel with the exhibit 3 or the exhibit held between holding sheets 3.

Figure 2:
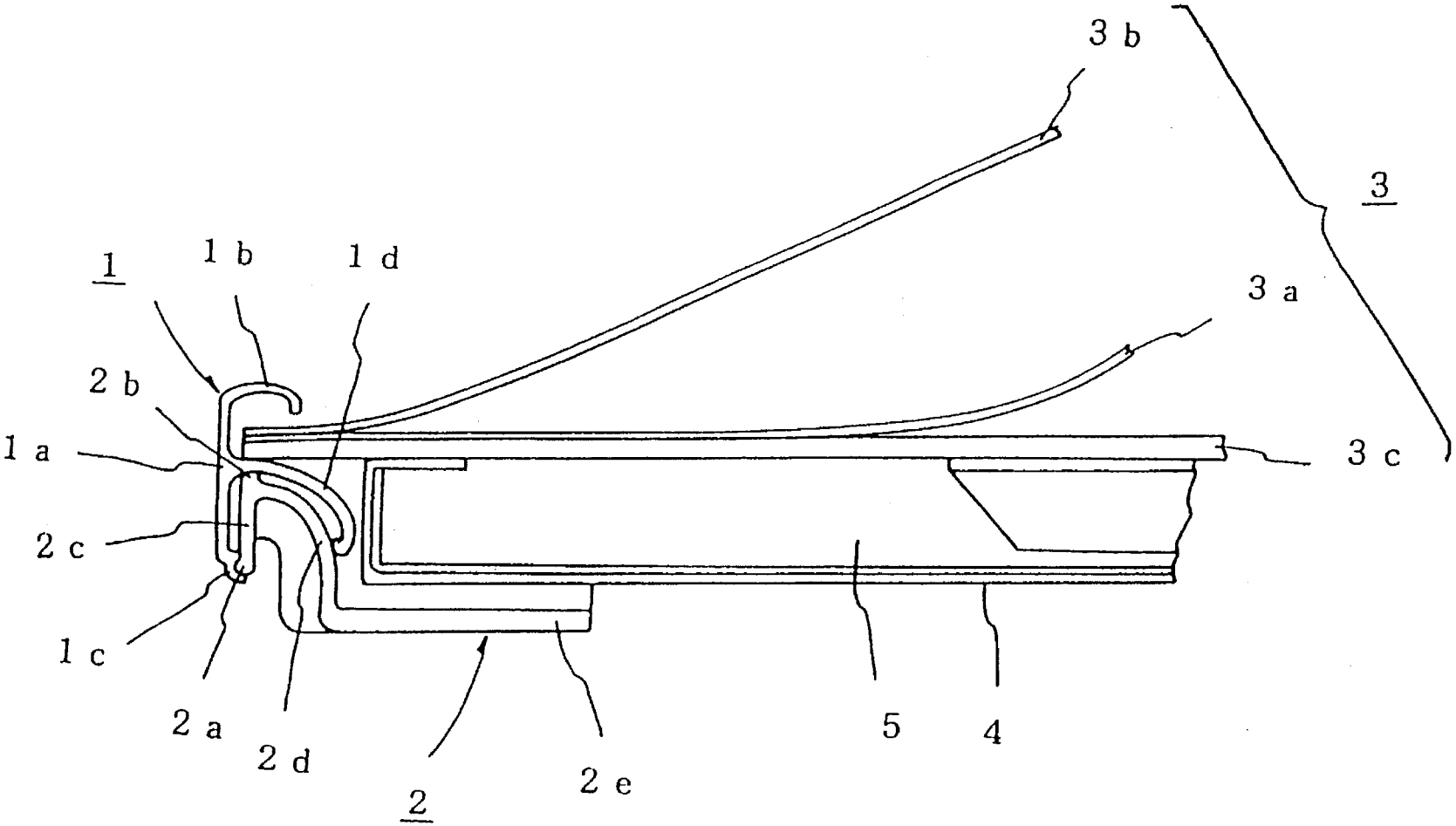
FIG. 2 is a sectional illustration showing an important portion of FIG. 1.

In the example illustrated in FIGS. 1 and 2, the respective framing straight members 1 can be pivotally rotated respectively in four directions, i.e., in outward directions, and the exhibit 3 or the exhibit held between holding sheets 3 and a container 4 can be accessed from the front side of the frame device, for removal and installation. The exhibit 3 or the exhibit held between holding sheets 3 of the present invention can be either a picture, poster or testimonial, etc. made of paper or paper-like material as an exhibit 3*a* only or the exhibit 3*a* held between a transparent front holding sheet 3*b* covering the front side and a back holding sheet 3*c* supporting the back side. The transparent front holding sheet 3*b* and the back holding sheet 3*c* are not especially limited.

Figure 3:
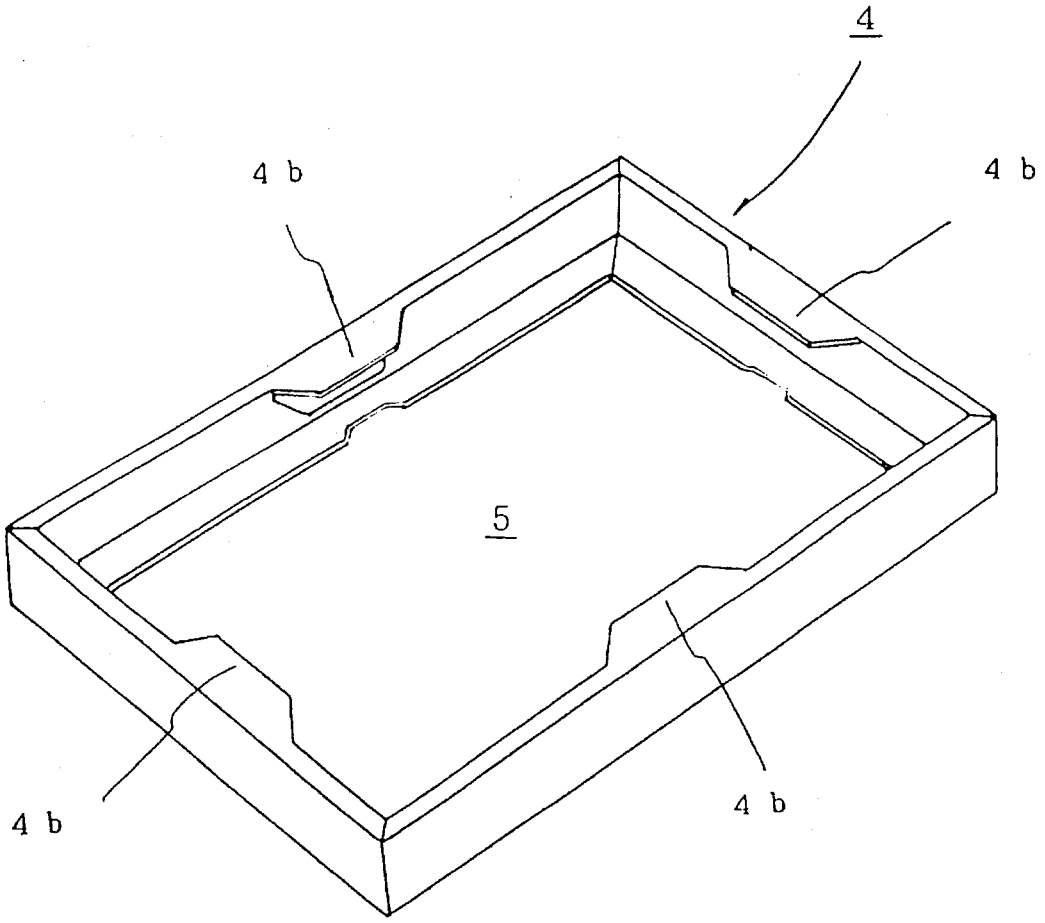
FIG. 3 is a perspective view showing an example of the container.
Figure 4:
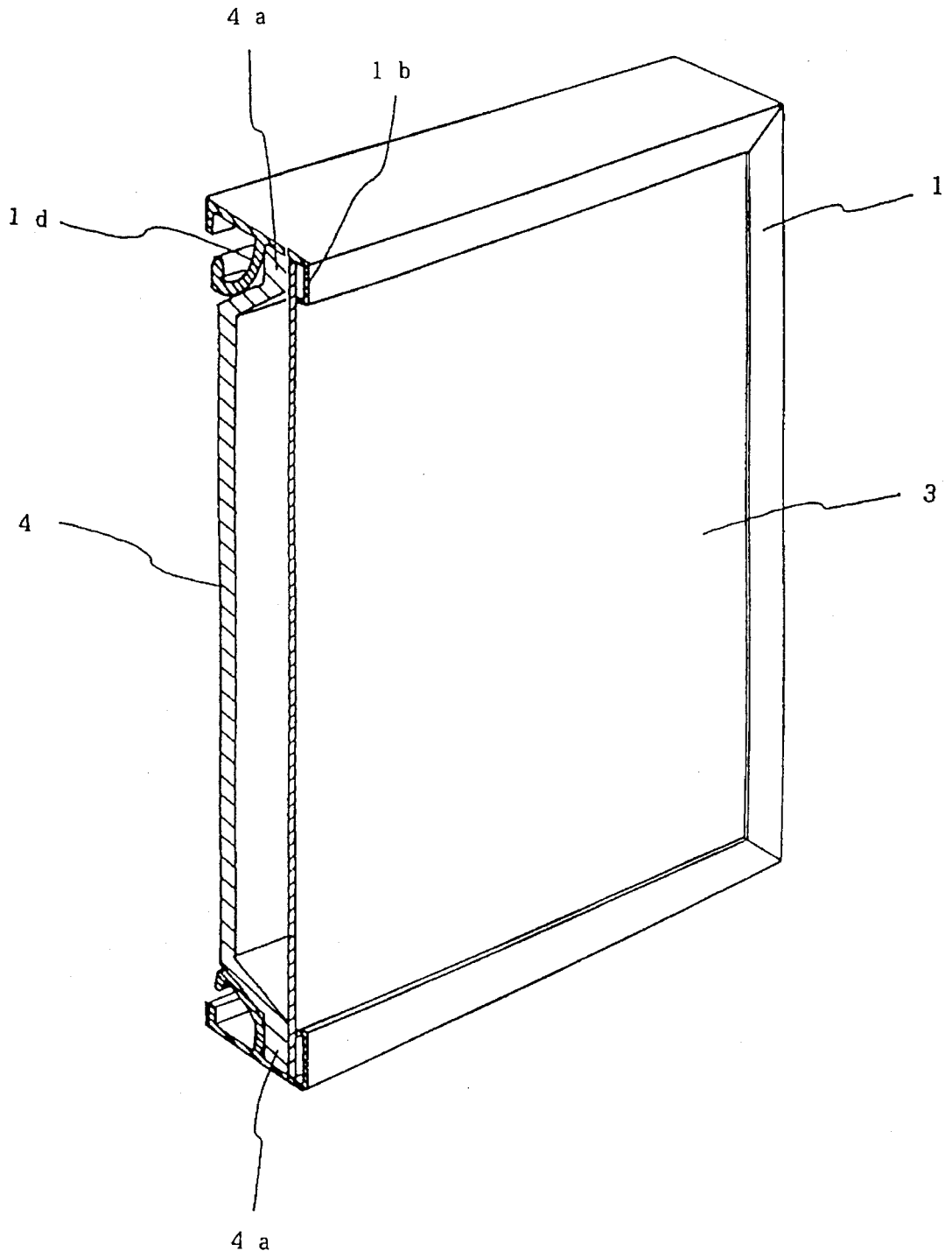
FIG. 4 is a partially cutaway perspective view showing another example.

The container 4 forms a space as illustrated in FIGS. 1 to 3, and together with the exhibit 3 or the exhibit held between the holding sheets 3, it is held between the holding portions 1*b* of the framing straight members 1 and the corner joint boards 2*e*.

In the example illustrated in FIG. 3, the container 4 like a thin tray with the space 5 opened on the exhibit 3 side is installed between the back side of the back holding sheet 3*c* and the front side of the corner joints 2. To prevent the other exhibitable sheets than the exhibit contained in the container 4 from coming off, come-off preventing flaps 4*b* are protruded inward from the edges of the opening.

The container 4 forms the space 5 with a dish-like recess which can contain the other exhibitable sheets than the exhibit, and has flanges 4*a* formed to protrude outward from the edges of the space 5. Together with the the exhibit 3 or the exhibit held between the sheets 3, the flanges 4*a* are held between the holding portions 1*b* of the framing straight members 1 and the partitions 1*d*.

Together with the exhibit 3 or the exhibit held between holding sheets 3, the flanges 4*a* of the container 4 with the space 5 are placed between top portions of the partitions 1*d* of the framing straight members 1 and the tips of the holding members 1*b*, and the respective framing straight members 1 are pivotally rotated for holding them.

In the present invention composed as described above, at first the four framing straight members 1 are connected at their butt corners by the corner joints 2. The pivotal rotation base strips 2*c* of the corner joints 2 can be respectively fitted into the openings between the pivotal rotation supporting portions 1*c* and the tips of the partitions 1*d* of the framing straight members 1 by using the resilience of the material. Before pivotal rotation, the exhibit 3 or the exhibit between holding sheets 3 and the container 4 are overlapped, and placed above the corner joint boards 2*c* of the corner joints 2, and the respective framing straight members 1 are pivotally rotated, to assemble a frame device displaying the exhibit 3 or the exhibit held between holding sheets 3 and surrounded on the four sides. If one of the four framing straight members 1 is pivotally rotated to be opened, the exhibit 3 or the exhibit held between holding sheets 3 can be slid horizontally, to open the space 5 of the container 4 as shown in FIG. 1. From the opening, other exhibitable sheets than the exhibit can be easily taken out and in.

The space 5 with a certain height formed in the container 4 of the frame device can contain many other exhibitable sheets than the exhibit. Since the space 5 is almost as large as the frame in area, exhibitable sheets as large as the exhibit can also be contained.

INDUSTRIAL AVAILABILITY

The present invention can contain many other exhibitable sheets than the exhibit in the space, and if one of the four framing straight members is pivotally rotated and the back holding sheet is slid, then the space can be easily opened. So, other exhibitable sheets than the exhibit can be easily confirmed, and the present invention can very significantly present a highly practical frame device.

I claim:

1. A picture frame device, comprising framing straight members having at least two ends, corner joints pivotally rotatably fitted at respective both ends of the framing straight members, an exhibit held on a front side of the framing straight members, and a container installed behind the exhibit, wherein each of the framing straight members has a holding portion formed inward at a front end to hold a surface of the exhibit and a pivotal rotation supporting portion formed inward at a back end of the framing straight members; from an intermediate position between the holding portion and the pivotal rotation supporting portion is extended a partition at least partially located on a pivotal rotation are formed with the pivotal rotation supporting portion as an approximate center; each of the corner joints has a pivotal rotation base strip engaged, at a back end of the corner joint, with the pivotal rotation supporting portion of the framing straight member, and kept, at a front end of the corner joint, in slidable contact with the partition and engaged partially with the partition; extending from the pivotal rotation base strip is an arcuate portion which is kept in slidable contact and engaged with a tip of the partition; from the arcuate portion, a corner joint board is further extended; and said container has a space formed, and together with the exhibit, the container is installed between the holding portions of the framing straight members and the corner joint boards.

* * * * *